United States Patent [19]

Resnick et al.

[11] Patent Number: 4,929,211

[45] Date of Patent: May 29, 1990

[54] HAND HELD TACTILE TOY

[75] Inventors: Susan D. Resnick, New York, N.Y.; Angela M. Nuyens, Nashville, Tenn.

[73] Assignee: Softspot, Inc., Nashville, Tenn.

[21] Appl. No.: 278,905

[22] Filed: Dec. 2, 1988

[51] Int. Cl.[5] ..... A63H 33/00; A63H 3/52; A63B 11/08

[52] U.S. Cl. ..... 446/14; 446/267; 446/486; 272/68

[58] Field of Search ..... 446/14, 26, 27, 28, 446/267, 71, 72, 76, 77, 78, 79, 81, 268, 385, 486, 490; 128/359; 272/67, 68

[56] References Cited

U.S. PATENT DOCUMENTS

| | | | |
|---|---|---|---|
| 1,171,229 | 2/1916 | Morse | 446/419 |
| 1,549,710 | 8/1925 | Campbell | 272/68 |
| 2,582,514 | 1/1952 | Swisher et al. | 446/268 X |
| 2,685,760 | 8/1954 | Wagner | 446/392 |
| 3,334,899 | 8/1967 | Bosko et al. | 446/267 X |
| 3,347,545 | 10/1967 | Nichols | 446/267 X |
| 3,517,933 | 6/1970 | Malkin | 446/267 X |
| 3,557,776 | 1/1971 | Boots | 272/68 X |
| 3,955,314 | 5/1976 | Robb | 446/72 |
| 3,980,300 | 9/1976 | Hornsby, Jr. | 446/14 X |
| 4,040,619 | 8/1977 | Landi | 446/490 X |
| 4,153,248 | 5/1979 | Holmes et al. | 272/68 X |
| 4,165,070 | 8/1979 | Rice | 272/68 |
| 4,618,213 | 10/1986 | Chen | 446/486 X |

FOREIGN PATENT DOCUMENTS

| | | | |
|---|---|---|---|
| 515089 | 12/1930 | Fed. Rep. of Germany | 446/267 |
| 1112170 | 11/1955 | France | 272/68 |
| 27934 | of 1905 | United Kingdom | 272/68 |
| 374124 | 6/1932 | United Kingdom | 446/267 |
| 550961 | 2/1943 | United Kingdom | 272/68 |
| 2170727 | 8/1986 | United Kingdom | 446/267 |

*Primary Examiner*—Mickey Yu
*Assistant Examiner*—D. Neal Muir
*Attorney, Agent, or Firm*—Kenyon & Kenyon

[57] ABSTRACT

A shaped object that fits into the palm of the hand to give a pleasurable tactile sensation is disclosed. The tactile sensation is created by a unique combination of resistant and pliable sections in the object.

18 Claims, 3 Drawing Sheets

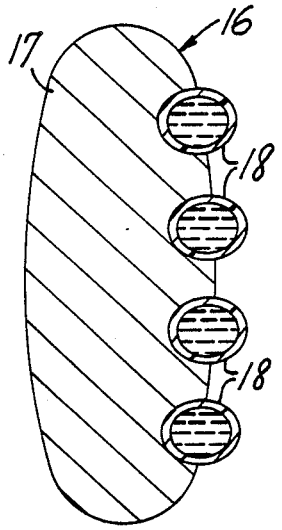
FIG. 5
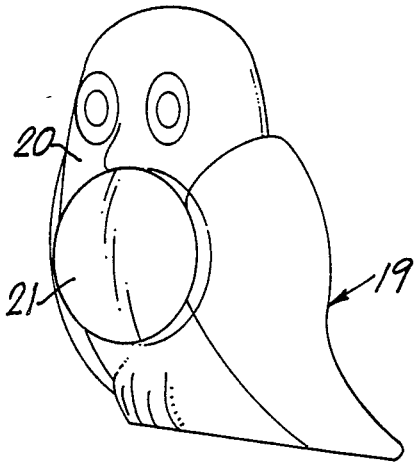
FIG. 6
FIG. 7
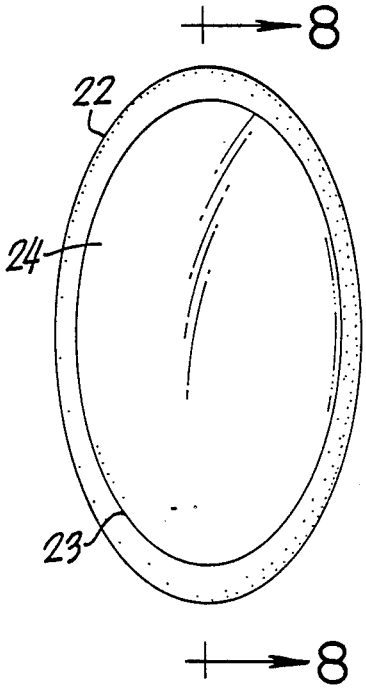
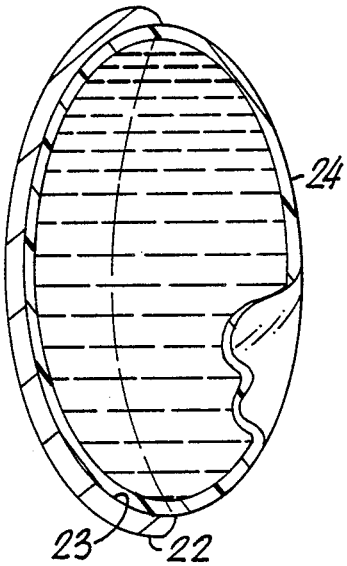
FIG. 8
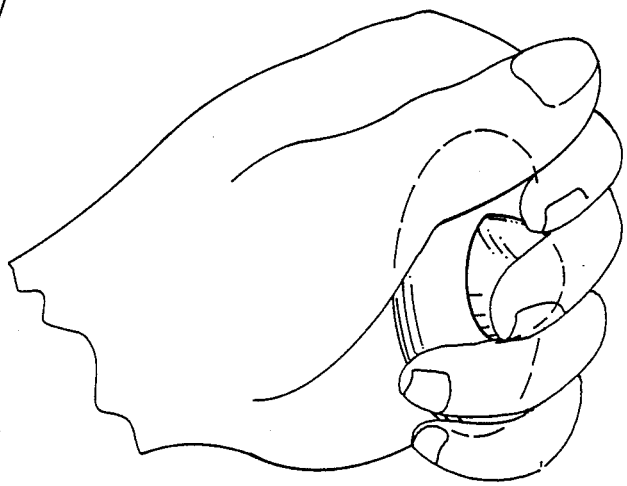
FIG. 9

HAND HELD TACTILE TOY

BACKGROUND OF THE INVENTION

The present invention relates to a hand held tactile toy or amusement device having exterior surfaces of differing texture and resiliency. The sensation associated with holding and manipulating an object comprising different textures and/or resiliency provides both physical and psychological pleasure, particularly a sense of calmness and sereneness. The device can therefore aid in reducing anxiety as well as induce a comfortable, relaxed state of mind.

BACKGROUND ART

The following patents typify hald-held objects which have components which are pliable to some degree.

U.S. Pat. No. 1,549,710 describes an oblong object having a compressible outer shell and an inner core of air.

U.S. Pat. No. 3,265,389 describes an object of uniformly resilient material having open areas.

U.S. Pat. No. 2,994,530 describes an object for exercising particular parts of the hand. Two connected rigid gripping bodies are provided with a wrap of a spongy resilient pad to provide a secure grip when the two grip members are compressed toward each other.

U.S. Pat. No. 4,040,619 describes an exercise device comprising a flexible hour-glass shaped object, having two interior compartments containing a liquid which can be squeezed from one compartment to the other.

U.S. Pat. No. 4,754,963 describes a hand held exercise device having a generally puck-shaped body of resilient material within which are openings containing relatively rigid ball members held by friction in the openings of the resilient material. The inserted balls provide increased resistance to compression of the puck-shaped body.

In common, none of these patents disclose a hand-held tactile object wherein a hard smooth body has a portion of its surface interrupted by cavities containing soft pliable bodies which protrude from the surface of the hard body. In contrast to the prior art devices, the present invention provides a generally rigid support body and requires little or no applied pressure to achieve the benefits of contrasting sensations of a hard smooth surface interrupted by one or more smooth pliable soft surfaces.

SUMMARY OF THE INVENTION

In accordance with the invention, a generally oblong smooth, hard body which resides comfortably in the palm of the hand is provided with at least one cavity within which resides a pliable, smooth, generally round or ellipsoid soft body. A portion of the soft body protrudes from the first body and provides an independent and localized area of contact and pressure with the hand. The tactile contrast of the smooth relatively unyielding surface of the hard body with pliable forgiving nature of the soft body provides a pleasing sensation to the holder. The object can be manipulated so that different portions of the hand come in contact with the pliable second body, thus moving the contrasting of hard-/soft bodies to differing sensing areas of the hand.

BRIEF DESCRIPTION OF THE DRAWINGS

In the drawings:

FIG. 5 is a view along line 5—5 of FIG. 3.

FIG. 6 is an isometric view of an embodiment of the invention.

FIG. 7 is the plan view of another embodiment of the device of the invention.

FIG. 8 is a partial section taken along lines 8—8 of FIG. 7.

FIG. 9 depicts an embodiment of the invention held in a hand.

DETAILED DESCRIPTION OF THE INVENTION

Figure 1:
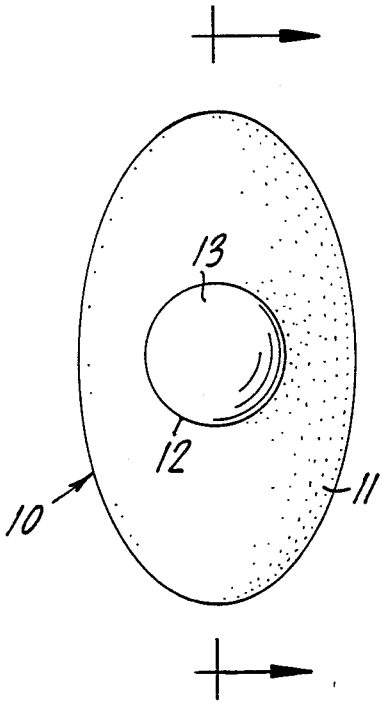
FIG. 1 is a plan view of one embodiment of the device of the invention.
Figure 2:
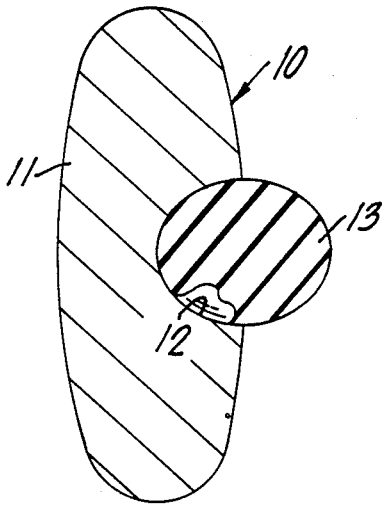
FIG. 2 is a view along line 2—2 of FIG. 1

Referring to FIGS. 1 and 2 of the drawings the device of the invention show is a hand held tactile object 10 which comprises a smooth hard body 11 whose surface has a cavity 12 which is adapted to receive a generally round, smooth soft body 13 made from a pliable material. The soft body 12 fills only a portion of the cavity, there being at least a substantial portion of the soft body which protrudes from the cavity and extends beyond the surrounding surface areas of the hard body 11. The size of the hard body 11 is that which would comfortably fit within the human hand. Different sizes could be provided for persons of different hand-size or growth. A generally oblong shape is shown for the rigid body as this is a comfortable shape for the hand and maximizes the area of tactile contact and hence sensation. The soft body, on the other hand, provides a separate area of contact. Because it protrudes, the soft pliable nature of the body will necessarily be sensed when the object is held and squeezed. However, the different sensation does not require much pressure, and ordinarily the weight of the object itself will suffice the "squeeze" the smooth resilient body when the latter is positioned against the palm of the hand.

The important feature is that both bodies be relatively smooth, i.e., not rough, and that both be of substantially different resiliency. Although overall smoothness is preferred, the hard body 11 can have some texture, such as the strippled effect of leather. The hard body can be made of any relatively hard material, such as rigid plastics, glass, hard rubber, reconstituted marble, reconstituted stone, metal or wood. Glass, stone, metal and plastic tend to give a "cool" feel, not unlike that of crystal hand-coolers. Wood and hard rubber give a warmer silky feel.

Suitable plastics are, for example, acrylic or Lucite®. Plastics and glass can be clear, but they may also be pigmented or not, to make the hard body a colored transparent, translucent or opaque material. The soft body 13 can be formed from any of the generally known elastomeric polymers, synthetic or natural. For example, elastomers of polybutadiene/styrene, cispolybutadiene, butyl rubber, ethylene-propylene rubber, and polyisoprene are useful. It is generally preferred that such elastomers be from formulations of relatively low hardness and high softness, in order to maximize the contrast with the hard body 10 and to allow depression of the resilient body 12 with relatively little pressure. Although a resilient elastomer is preferred, it is also contemplated that the soft body be made from malleable materials that maintain their shape to some degree when distorted, such as shape-memory polymers of transpolyisoprene.

Figure 3:
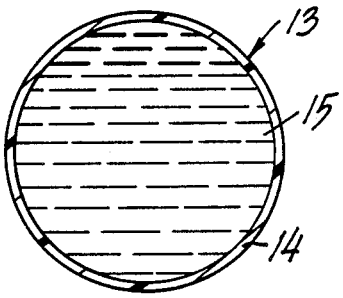
FIG. 3 is a section view of one embodiment of the soft body of the invention.

A preferred embodiment of the soft body 12 is depicted in FIG. 3. That figure shows a soft body 14 having an outer skin or shell 14 of a soft elastomer and an inner core 15 of a viscous liquid or gel-like substance. Very low molecular weight elastomeric polymers make an appropriate gel or liquid core. The combination of FIG. 3 gives a particularly soft, pliable feel and can be depressed with little energy. A preferred example of such a composite elastomeric structure is a silicone elastomer filled with a silicone gel. Silicone elastomers are well known (e.g., Sylgard® 184 or Silastic® Q7-2213 or Q7-2630 from Dow Corning Corp., Midland, Mich.). The base silicone polymer can be formed by known means into a tough, pliable, virtually transparent film. The film preferably has a thickness of between about 0.007 inch and 0.020 inch, with 0.010 inch being preferred. Thicknesses outside this range may be used but are less preferred because thinner thicknesses increase the risk of puncture and thicker ones have less tactile appeal. Typically the film is built up on a mandrel through repeated dippings in a bath of siloxane polymer. When the desired thickness is reached, the film is vulcanized and then sealed into a generally round shape with a silicone adhesive, like, for example, Silastic® adhesive from Dow Corning. The shell 16 thus formed can then be filled with a clear siloxane gel, for example, polydimethylsiloxane (PDMS). A PDMS gel system is available commercially as Q7-2218, Q7-2167/Q7-2108, or Q7-2150/Q7-2146 Silicone Gel Systems from Dow Corning. The gel itself is made in known manner by curing the gel base resin with a suitable polysiloxane hardener. The filling step can be done with a hypodermic needle, the hole being sealed with silicone adhesive. Previously prepared encapsulated gels of the type described exist in commerce and have been used in medical applications such as in female breast repair and testicular implants.

The weight of the object 10 is normally dictated by the composition of the hard body 11. For lighter weights an acrylic plastic can be used. If a heavier weight is desired, one can select from the heavier materials such as stone, metal and glass. The selection of materials may also be dictated by the desire to achieve a certain visual appearance, e.g., clear vs. opaque, or dark vs. light, or metallic vs. glass-like.

The gel-filled soft body 13 of FIG. 3 is generally clear and can provide a pleasant visual contrast with the various choices of materials available for the hard body 11. It is also contemplated by this invention to achieve visual effects in addition to those dictated by the choice of materials for the rigid body and the soft body. The gel 17 may itself be pigmented to provide additional visual effects. It is also contemplated by this invention that the core of the soft body 13 contain, in addition to the gel or viscous liquid, admixed thermochromic liquid crystals which are capable of changing color in reaction to temperature changes created by the warmth of the hand, as by the pressure of the hand. Such crystals, also known as cholesteric or chiral nematic crystals, change color at low temperatures, generally going from clear to red as the temperature is changed or pressure is increased and then on to other colors as the temperature or pressure continues to change. When using such crystals in a clear soft body 13 of the invention, the back of the cavity 12 is suitably colored flat black to provide better contrast and visualization. It is preferred that such crystals be of the micro-encapsulated variety. Thermochromic liquid crystals are available from Hallcrest, Inc. of Glenview, Ill. The amount of such crystals needed to provide a desired visual effect, depending on the clarity of the soft body 13 and the reflectivity of the selected cavity, can be readily established through trial.

Figure 11:
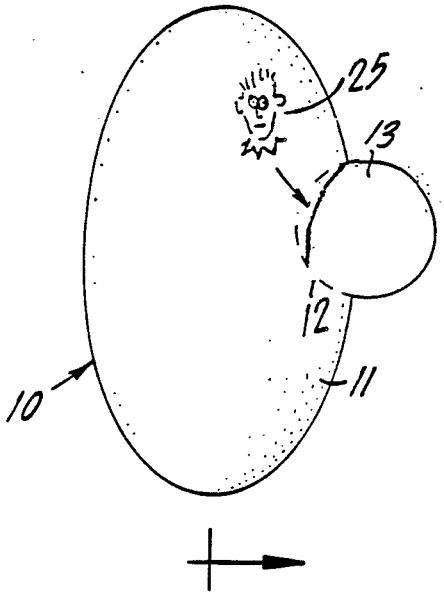
FIG. 11 depicts a side view of an embodiment wherein an image is included between the soft body and the cavity.
Figure 12:
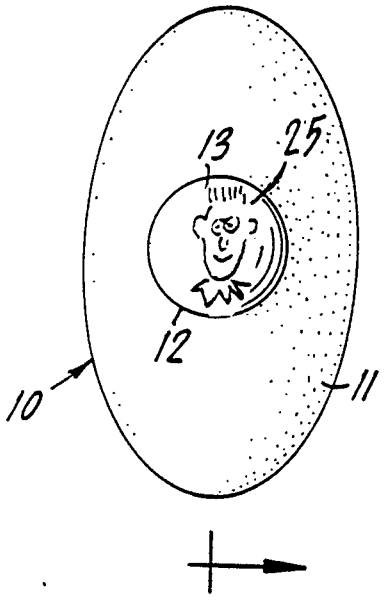
FIG. 12 depicts a front view of an embodiment wherein an image is located between the soft body and the cavity.

As noted, the capsules or soft bodies are of generally round shape, but they may also be oblong, egg-shaped, pear shaped, etc. Thus, by "generally round" I do not limit myself to spheroids, but include ellipsoid bodies having substantially continuous surfaces wherein at least some of the plane sections are circles or ellipses. A round clear body will behave naturally like a magnifying a lens. Therefore it is further contemplated by this invention that the cavity of the hard body can contain a colored symbol, insignia, message or other image which will be magnified by the clear soft body Referring to FIGS. 11 and 12, such an embodiment is depicted wherein an image 25 located between the cavity and the soft body is magnified when viewed from the front. It could be used, for example, to provide indicia of an event, organization or award. The whole object 10 could therefore be suitable for presentations, advertising, and promotional gifts. The image to be observed through the soft clear body could be attached in any suitable manner such as a coating applied to the cavity wall or on the adjacent surface of the soft body or on a separate film or sheet placed in the back of the cavity before the soft body is put in the cavity.

Depending on the rigidness and relative resilience of the hard body and the soft body, the latter may either be held in the cavity by friction, or by an adhesive appropriate to the selection of materials. In most cases, an adhesive will be required. In the event no adhesive is used, the soft body may be removed and exchanged for other soft bodies of contrasting properties (e.g, colored rather than clear, or containing thermochromic liquid crystals, or containing a different symbol on the interior surface).

Figure 4:
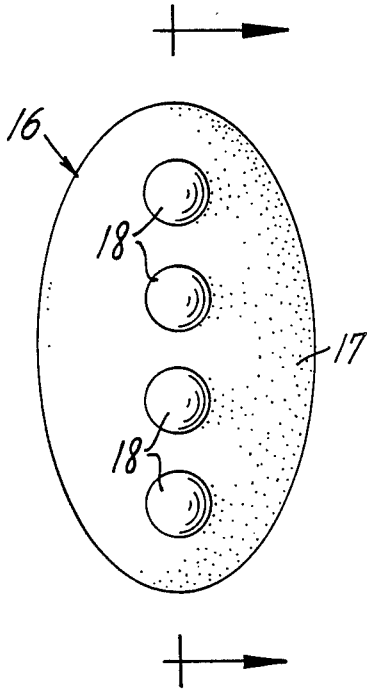
FIG. 4 is a plan view of another embodiment of the device of the invention.
Figure 10:
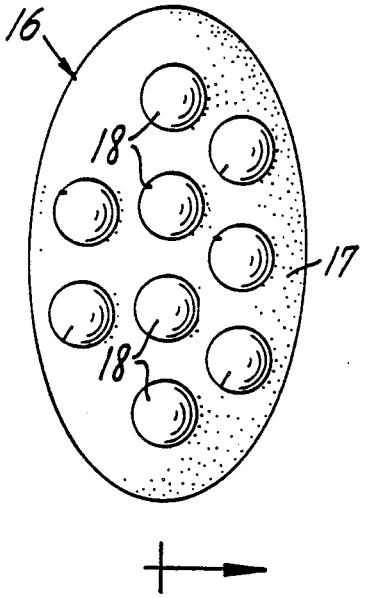
FIG. 10 depicts an embodiment of the invention wherein the object has a plurality of soft bodies.

The hard body may be provided with a multiplicity of cavities containing soft bodies. FIGS. 4 and 5 depict such an embodiment. There, the hand held tactile object 16 comprises a hard smooth body 17 having several cavities which receive smooth soft, pliable protruding bodies 18. This embodiment spreads out the areas of soft contact when the object is held in the hand and thereby changes the over-all tactile information the holder senses. The number of such soft contact areas and hence the relative sensations between softness and hardness is obviously a matter of choice. Conceivably the entire surface could be covered by the soft bodies in which case the sensation is almost totally one of smooth softness supported by the heft and weight of the hard body 17. FIG. 10 depicts such an embodiment. Here too, any of the soft bodies, when made of a clear material such as silicone elastomer/gel, could be modified to contain thermochromic crystals, pigmentation or magnified indicia as indicated above for the single soft body. However, with the multiple soft bodies, one could provide each or any of the bodies with different such treatments thereby creating, if desired, image/patterns from the composite effect of the differing treatments of individual soft bodies.

Users of tactile toys take particular pleasure in observing and handling an object in the shape of an animal. Hence, it is advantageous to make the body in the shape of an animal, such as a bird, rabbit, cat, etc. FIG. 6 depicts such an embodiment in the shape of an owl 19. The cavity for receiving the soft body 21 is located in the breast area of the hard body 20. The contours of the body are kept smooth and with a minimum of sharp features or detail so that the object as a whole will still feel comfortable in the hand. The user could derive tactile pleasure by gently touching or poking the animal in the soft area of the central body with the finger from one hand while holding the animal in the other, or the user could hold the object in the palm of the hand, squeezing the soft component against the fat of the palm or by the thumb.

FIGS. 7 and 8 depict another embodiment in which the hard body 22 resembles a hollowed out semi-ellipsoid, the cavity being substantially co-extensive with a plane through the central axis of the ellipse (as shown in FIG. 7). A single relatively large soft body 24 resides within that cavity. In this embodiment the single soft body has almost the same contact area with the hand as the hard body.

Having thus described my invention, I claim:

1. A tactile relaxation object comprising a hard body sized to fit within an adult human hand and having a smooth surface containing at least one cavity, each said cavity containing and filled by a generally round, smooth resilient soft body, a substantial portion of which protrudes from and extends beyond said smooth surface of the hard body and which comprises an outer elastomeric shell and an inner viscous fluid whereby an adult would be able to hold said tactile object and manipulate said soft body.

2. The object of claim 1 wherein the hard body is made from the class consisting of glass, plastic, marble, stone or wood.

3. The object of claim 1 wherein said hard body has only one cavity.

4. The object of claim 1 wherein said hard body has a multiplicity of cavities.

5. The object of claim 4 wherein the number of cavities is sufficient to substantially cover the surface of said hard body with soft bodies.

6. The object of claim 1 wherein said elastomeric shell comprises silicone.

7. The object of claim 1 wherein said inner viscous fluid comprises a polymeric gel of silicone.

8. The object of claim 1 wherein at least one of said soft bodies is clear.

9. The object of claim 8 wherein a visual image is located between at least one soft-body containing cavity wall and the adjacent surface of the clear soft body contained therein, said image being observable through the soft body.

10. The object of claim 9 wherein the image is coated on the cavity wall.

11. The object of claim 8 wherein at least one of the clear soft bodies contains a thermochromic liquid crystal.

12. The object of claim 1 wherein the relatively soft body is generally round or oblong in shape.

13. The object of claim 1 wherein at least one of the soft bodies is translucent.

14. The object of claim 9 wherein the image is coated on the surface of the soft body adjacent to the soft-body cavity.

15. The object of claim 3 wherein said hard body is in the shape of an animal.

16. The object of claim 15 wherein said soft body is located in the chest area of said animal.

17. The object of claim 15 wherein said soft body is located in the stomach area of said animal.

18. The object of claim 15 wherein the hard body is in the shape of an owl and the soft body comprises an outer elastomeric shell comprising a silicone polymer and said inner viscous fluid comprises a polymeric silicone gel.

* * * * *